US009318093B2

(12) United States Patent
Goto

(10) Patent No.: US 9,318,093 B2
(45) Date of Patent: Apr. 19, 2016

(54) ACTIVE NOISE-REDUCTION APPARATUS AND METHOD

(71) Applicant: KABUSHIKI KAISHA TOSHIBA, Minato-ku, Tokyo (JP)

(72) Inventor: Tatsuhiko Goto, Kanagawa (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 0 days.

(21) Appl. No.: 14/495,068

(22) Filed: Sep. 24, 2014

(65) Prior Publication Data

US 2015/0086031 A1 Mar. 26, 2015

(30) Foreign Application Priority Data

Sep. 24, 2013 (JP) ..... 2013-197034

(51) Int. Cl.
*G10K 11/16* (2006.01)
*G10K 11/178* (2006.01)

(52) U.S. Cl.
CPC ..... *G10K 11/178* (2013.01); *G10K 2210/3016* (2013.01); *G10K 2210/3026* (2013.01);
(Continued)

(58) Field of Classification Search
CPC ..... H03G 5/00; H03G 5/005; H03G 5/16; H03G 5/165; H03G 5/24; H03G 5/28; H03G 9/005; H03G 9/24; H03G 9/025; H03G 2201/702; H03G 7/007; H04R 3/02; H04R 3/04; H04R 3/06; H04R 3/08; H04R 3/14; H04R 3/007; H04R 5/04; H04R 25/453; H04R 25/50; H04R 25/505; H04R 25/507; H04R 1/1091; H04R 1/10; H04R 1/08; H04R 29/001; H04R 3/00; H04R 3/002; H04R 2420/07; H04R 2499/11; H04R 2217/03; H04R 2225/41; H04R 2225/43; G06F 3/165; G06F 17/3074; G10K 11/175; G10K 11/16
USPC ..... 381/28, 59, 55, 317, 318, 321, 74, 72, 381/26, 56, 57, 71.1, 71.11, 71.14, 83, 86, 381/302, 332, 93, 96, 97, 98, 99, 100, 101, 381/102, 103, 106, 107, 108, 120, 121; 327/551, 552, 553, 555, 560; 704/E21.007, E21.02; 379/406.01–406.16; 455/570
See application file for complete search history.

(56) References Cited

U.S. PATENT DOCUMENTS 5,469,510 A * 11/1995 Blind ..... H03G 9/005 381/55

(Continued)

FOREIGN PATENT DOCUMENTS

| | | |
|---|---|---|
| JP | 5-6187 | 1/1993 |
| JP | 6-175667 | 6/1994 |
| JP | 9-319403 | 12/1997 |

OTHER PUBLICATIONS

Bai et al "Reduction of Electronic Delay in Active Noise Control Systems—A Multirate Signal Processing Approach", J. Acoustic Society, vol. 111, No. 2, Feb. 2002, pp. 916-924.*

(Continued)

*Primary Examiner* — Leshui Zhang
(74) *Attorney, Agent, or Firm* — Ohlandt, Greeley, Ruggiero & Perle, L.L.P.

(57) ABSTRACT

According to an embodiment, an active noise-reduction apparatus includes following elements. The microphone converts a sound including a target sound into an error signal. The control filter generates a control signal in accordance with a control characteristic. The first control effect estimation filter converts the control signal into a first signal in accordance with an estimated secondary path characteristic. The second control effect estimation filter converts the control signal into a second signal in accordance with a processed secondary path characteristic obtained by shortening a delay of the estimated secondary path characteristic. The updating unit updates the control characteristic based on the error signal, the first signal, and the second signal.

16 Claims, 13 Drawing Sheets

(52) U.S. Cl.
CPC ..... *G10K2210/3027* (2013.01); *G10K 2210/3028* (2013.01); *G10K 2210/3044* (2013.01); *G10K 2210/3055* (2013.01)

(56) References Cited

U.S. PATENT DOCUMENTS 5,517,571 A * 5/1996 Saruta ..... G10K 11/1784 381/71.11
5,940,519 A * 8/1999 Kuo ..... G10K 11/1784 381/71.1
8,611,552 B1 * 12/2013 Murgia ..... H04R 1/1083 381/71.1
2005/0207585 A1 * 9/2005 Christoph ..... G10K 11/1784 381/71.11
2007/0076896 A1 * 4/2007 Hosaka ..... G10K 11/1788 381/71.11
2008/0144853 A1 * 6/2008 Sommerfeldt ..... G10K 11/1788 381/71.11
2008/0181422 A1 * 7/2008 Christoph ..... G10K 11/1784 381/73.1
2008/0192948 A1 * 8/2008 Kan ..... F02B 77/13 381/71.4
2009/0086990 A1 * 4/2009 Christoph ..... H04R 3/04 381/71.12
2010/0189275 A1 * 7/2010 Christoph ..... H04R 3/005 381/66
2010/0195844 A1 * 8/2010 Christoph ..... G10K 11/178 381/71.11
2010/0284546 A1 * 11/2010 DeBrunner ..... G10K 11/178 381/71.2
2011/0206214 A1 * 8/2011 Christoph ..... G10K 11/1784 381/71.6
2011/0299695 A1 * 12/2011 Nicholson ..... G10K 11/1782 381/71.6
2013/0028436 A1 * 1/2013 Christoph ..... H04R 3/00 381/73.1
2015/0172813 A1 * 6/2015 Goto ..... G10K 11/1784 381/71.1

OTHER PUBLICATIONS

Hinamoto, et al.; "Analysis of the Filtered-X LMS Algorithm and a Related New Algorithm for Active Control of Multitonal Noise"; IEEE Transaction on Audio, Speech, and Language Processing, vol. 14, No. 1, Jan. 2006, pp. 123-130.
Hinamoto, et al.; "Analysis of Linear and Nonlinear Filtered-X LMS Algorithm for Active Control of Multitonal Noise"; Institute of Electronics, Information, and Communication Engineers, Technical Report of IEICE; Jan. 2004; pp. 59-64.

* cited by examiner

| ID | Step size | Conventional method | First method | Second method |
|---|---|---|---|---|
| a | 0.005 | ○ | ○ | ○ |
| b | 0.01 | × | ○ | ○ |
| c | 0.015 | × | ○ | ○ |
| d | 0.02 | × | ○ | ○ |
| e | 0.025 | × | × | ○ |
| f | 0.03 | × | × | ○ |
| g | 0.035 | × | × | ○ |
| h | 0.04 | × | × | ○ |
| i | 0.045 | × | × | ○ |
| j | 0.05 | × | × | ○ |
| t | 0.1 | × | × | ○ |
| u | 0.2 | × | × | ○ |

ACTIVE NOISE-REDUCTION APPARATUS AND METHOD

CROSS-REFERENCE TO RELATED APPLICATIONS

This application is based upon and claims the benefit of priority from Japanese Patent Application No. 2013-197034, filed Sep. 24, 2013, the entire contents of which are incorporated herein by reference.

FIELD

Embodiments described herein relate generally to an active noise-reduction apparatus and method.

BACKGROUND

A method called Filtered-x is known as a basic method of ANC (Active Noise Control). In Filtered-x, when the distance between a control loudspeaker and an error microphone is long, the update rate of a control filter needs to be set sufficiently low to suppress divergence. If the update rate is made low, time is needed to generate a control effect.

In the ANC technology, it is necessary to efficiently reduce noise.

DETAILED DESCRIPTION

Figure 19:
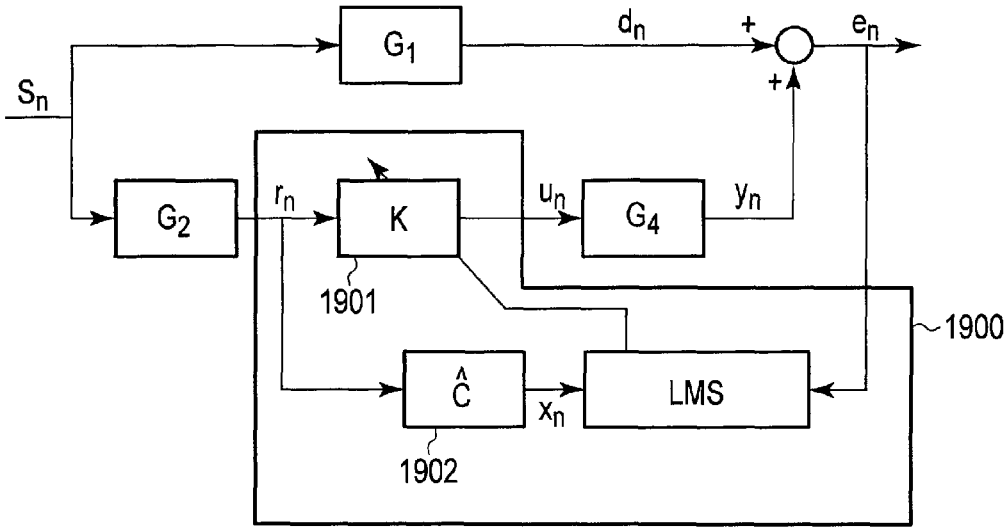
FIG. 19 is a block diagram showing the signal processor of a feedforward active noise-reduction apparatus according to a first comparative example.
Figure 20:
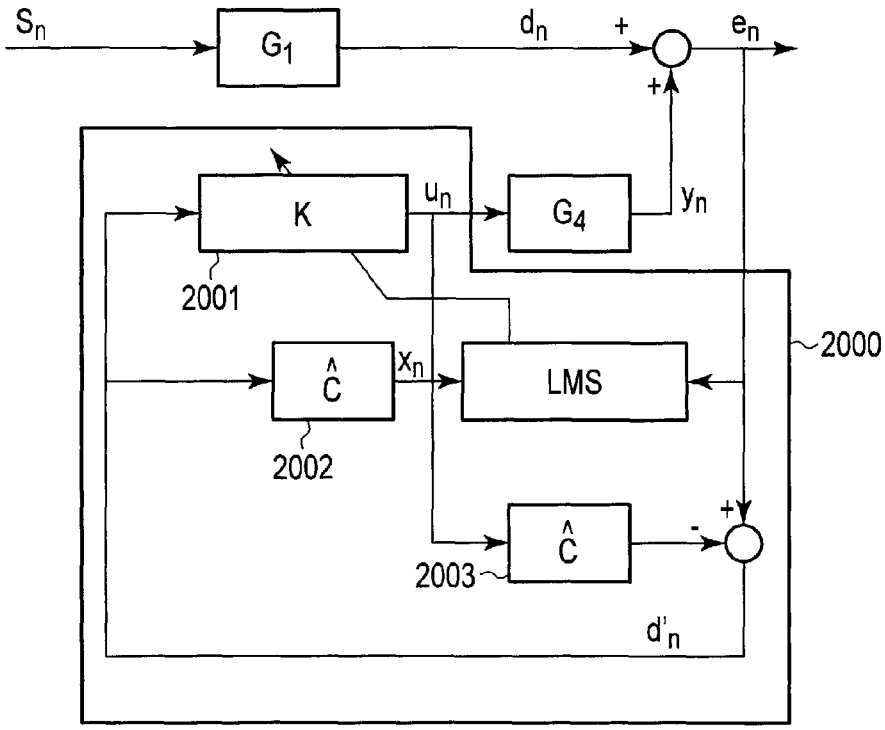
FIG. 20 is a block diagram showing the signal processor of an adaptive feedback active noise-reduction apparatus according to a second comparative example.

A Filtered-x LMS system generally used in ANC (Active Noise Control) will briefly be explained first with reference to FIGS. 19 and 20. A Filtered-x LMS algorithm uses an update rule called LMS (Least Mean Square) that is an update rule based on the steepest descent method. Filtered-x LMS systems are roughly divided into two types: a feedforward type and an adaptive feedback type.

A feedforward system will be described first.

FIG. 19 schematically shows a signal processor 1900 of a feedforward active noise-reduction apparatus according to a first comparative example. The active noise-reduction apparatus according to the first comparative example has the same device arrangement as an active noise-reduction apparatus (FIG. 1) according to each of the first and third embodiments (to be described later).

Referring to FIG. 19, noise generated by a noise source is represented by $s_n$, a reference signal acquired by a reference microphone is represented by $r_n$, an error signal acquired by an error microphone is represented by $e_n$, a sound that reaches the error microphone from the noise source is represented by $d_n$, and a sound that reaches the error microphone from a control loudspeaker is represented by $y_n$. The subscript "n" indicates a signal at a time n. A spatial transfer function from the noise source to the error microphone (to be also referred to as a primary path characteristic) is represented by $G_1$, a spatial transfer function from the noise source to the reference microphone is represented by $G_2$, and a spatial transfer function from the control loudspeaker to the error microphone (to be also referred to as a secondary path characteristic) is represented by $G_4$.

The filter characteristic of a control filter 1901 (to be referred to as a control characteristic hereinafter) is represented by K, and an estimated secondary path characteristic created in advance based on a result of identifying the secondary path characteristic is represented by $\hat{C}$. A control signal obtained by filtering the reference signal $r_n$ using the control filter 1901 having the control characteristic K is represented by $u_n$, and an auxiliary signal obtained by filtering the reference signal $r_n$ using a secondary path filter 1902 having the estimated secondary path characteristic $\hat{C}$ is represented by $x_n$.

The control filter 1901 is updated so that the error signal $e_n$ is minimized. More specifically, the control characteristic K of the control filter 1901 is updated by the steepest descent method so as to minimize an evaluation function represented by, for example, $$J = e_n^2 \tag{1}$$

$$e_n = d_n + y_n$$
$$= d_n + \phi_n^T \theta_C$$
$$\theta_C = [\theta_{C(0)}, \theta_{C(1)}, \ldots, \theta_{C(CL-1)}]^T$$
$$\phi_n = [u(n), u(n-1), \ldots, u(n-(CL-1))]^T$$

where $\theta_C$ is an FIR expression of the secondary path characteristic $G_4$, $\phi_n$ is the time series data of the control signal u, and CL is the filter length of $\theta_C$.

Assuming that the update rate of the control filter 1901 is low (that is, the control characteristic K slowly changes), and the secondary path characteristic is correctly identified, the error signal $e_n$ can be approximated by $$e_n \cong d_n + \zeta_n^T \theta_K$$
$$\theta_K = [\theta_{K(0)}, \theta_{K(1)}, \ldots, \theta_{K(KL-1)}]^T$$
$$\zeta_n = [x(n), x(n-1), \ldots, x(n-(KL-1))]^T$$
$$x_n = \zeta_n^T \theta_C$$
$$\zeta_n = [r(n), r(n-1), \ldots, r(n-(CL-1))]^T \tag{2}$$

where $\theta_K$ is an FIR expression of the control characteristic K, $\zeta_n$ is the time series data of the auxiliary signal x, $\zeta_n$ is the time series data of the reference signal r, and KL is the filter length of $\theta_K$.

In this case, when the evaluation function is partially differentiated by $\theta_K$, the instantaneous gradient of the evaluation function is obtained by $$\left(\frac{\partial e_n^2}{\partial \theta_K}\right)_{\theta_K = \theta_K(n)} = 2 e_n \zeta_n \tag{3}$$

Hence, the update rule is derived as $$\theta_K(n+1) = \theta_K(n) - 2\mu e_n \zeta_n \tag{4}$$

where μ is the step size in the steepest descent method.

Based on NLMS (Normalized Least Mean Square) updating, the update rule is represented by $$\theta_k(n+1) = \theta_K(n) - \frac{2\mu}{|\zeta_n|^2 + \beta} e_n \zeta_n \tag{5}$$

In the active noise-reduction apparatus according to the first comparative example, the control characteristic K of the control filter 1901 is updated in accordance with equation (4) or (5).

An adaptive feedback system will be described next. A description of the same parts as those described concerning the feedforward system will appropriately be omitted for the adaptive feedback system.

FIG. 20 schematically shows a signal processor 2000 of an adaptive feedback active noise-reduction apparatus according to a second comparative example. The active noise-reduction apparatus according to the second comparative example has the same device arrangement as an active noise-reduction apparatus (FIG. 4) according to each of the second and fourth embodiments (to be described later). The adaptive feedback system uses no reference microphone. Note that in the adaptive feedback system, the noise is fundamentally limited to periodic noise having periodicity.

Referring to FIG. 20, a signal obtained by filtering the control signal $u_n$ using a control effect estimation filter 2003 having the estimated secondary path characteristic $\hat{C}$ is represented by $z_n$, and an estimated noise signal obtained by subtracting the signal $z_n$ from the error signal $e_n$ is represented by $d_n'$. The signal $z_n$ represents the estimate of a sound that reaches the error microphone from the control loudspeaker, and the estimated noise signal $d_n'$ represents the estimate of a sound that reaches the error microphone from the noise source.

In the adaptive feedback system, the estimated noise signal $d_n'$ is given to a control filter 2001 and a secondary path filter 2002. When the noise is a periodic signal, the estimated noise signal $d_n'$ can be handled as the reference signal in the feedforward system, and the error signal can be reduced.

In the active noise-reduction apparatus according to the second comparative example as well, the control characteristic K of the control filter 2001 is updated in accordance with equation (4) or (5).

However, $$\zeta_n = [d'(n), d'(n-1), \ldots, d'(n-(CL-1))]^T.$$

As described above, according to Filtered-x LMS, the control filter is generally updated based on LMS (including NLMS) updating in both the feedforward type and the adaptive feedback type. The update rule is derived with the assumption that the update rate of the control filter is low, that is, the control characteristic K slowly changes. This assumption is called the slow adaptation limit.

However, when the update rate is low, time is needed to obtain the control effect. This is not desirable from the viewpoint of active noise control. In addition, when the delay in the secondary path characteristic is long in an environment where, for example, the control loudspeaker cannot be installed near the error microphone, the slow adaptation limit is untenable.

Breakdown of the slow adaptation limit in a case where the delay in the secondary path characteristic is long will be described. In the following mathematical expressions, the estimated noise signal d' in the adaptive feedback system is used. However, when the estimated noise signal d' is replaced with the reference signal r, the same description applies to the feedforward system.

The signal y(n) that reaches the error microphone from the control loudspeaker at the time n is given by $$y(n) = \sum_{i=0}^{CL-1} \theta_{C(i)} \left\{ \sum_{j=0}^{KL-1} \theta_{K(j)}(n-i) d'(n-i-j) \right\} \tag{6}$$

where C is the secondary path characteristic, CL is the filter length of the secondary path characteristic C, and KL is the filter length of the control characteristic K.

Assuming that the update rate of the control filter is low, and the secondary path characteristic is correctly identified, the signal y(n) can be represented by $$y(n) \cong \sum_{j=0}^{KL-1} \theta_{K(j)}(n) \left\{ \sum_{i=0}^{CL-1} \theta_{\hat{C}(i)} d'(n-i-j) \right\} \tag{7}$$

-continued $$\theta_{\hat{C}} = [\theta_{\hat{C}(0)}, \theta_{\hat{C}(1)}, \cdots, \theta_{\hat{C}(CL-1)}]^T$$

That is, the order of convolution can be approximately changed.

The update rule represented by equation (4) is derived using this approximation. For this reason, when the above assumption is untenable, the control filter diverges. For example, let a be the delay in the secondary path characteristic expressed as taps. According to equation (6), the influence of the control characteristic before K(n−a) is reflected on the signal y(n). In equation (7), however, K(n) is used. Hence, if the secondary path characteristic includes a long delay, the difference between equation (6) and equation (7) readily becomes large. For this reason, the update rate of the control filter needs to be low. That is, the step size μ needs to be small.

Various embodiments will be described below with reference to the accompanying drawings. Note that the same reference numerals denote parts that perform the same operations in the following embodiments, and a repetitive description will be omitted.

In general, according to an embodiment, an active noise-reduction apparatus for reducing a target sound having periodicity includes an error microphone, a reference signal generator, a control filter, a control loudspeaker, a first control effect estimation filter, an estimated noise signal generator, a second control effect estimation filter, and an updating unit. The error microphone converts a sound including the target sound into a first error signal. The reference signal generator is configured to generate a reference signal. The control filter is configured to convert, in accordance with a control characteristic, the reference signal into a control signal used to cancel the target sound. The control loudspeaker emits a control sound based on the control signal. The first control effect estimation filter is configured to convert the control signal into a first signal in accordance with an estimated secondary path characteristic, the estimated secondary path characteristic being generated based on a result of identifying a secondary path characteristic from the control loudspeaker to the error microphone in advance. The estimated noise signal generator is configured to generate an estimated noise signal by subtracting the first signal from the first error signal. The second control effect estimation filter is configured to convert the control signal into a second signal in accordance with a processed secondary path characteristic, the processed secondary path characteristic being obtained by shortening a delay included in the estimated secondary path characteristic by a time, the time corresponding to a period of the target sound multiplied by a constant. The updating unit is configured to update the control characteristic so that a second error signal which is a sum of the estimated noise signal and the second signal is minimized. Letting T be the period, a be the delay, and m be the constant, the constant is a positive integer satisfying T×m≤a.

In general, according to another embodiment, an active noise-reduction apparatus for reducing a target sound includes an error microphone, a reference signal generator, a control filter, a control loudspeaker, a control effect estimation filter, a secondary path filter, a virtual control effect estimation filter, and an updating unit. The error microphone converts a sound including the target sound into an error signal. The reference signal generator is configured to generate a reference signal. The control filter is configured to convert, in accordance with a control characteristic, the reference signal into a control signal used to cancel the target sound. The control loudspeaker emits a control sound based on the control signal. The control effect estimation filter is configured to convert the control signal into a first signal in accordance with an estimated secondary path characteristic, the estimated secondary path characteristic generated based on a result of identifying a secondary path characteristic from the control loudspeaker to the error microphone in advance. The secondary path filter is configured to convert the reference signal into a first auxiliary signal in accordance with the estimated secondary path characteristic. The virtual control effect estimation filter is configured to convert the first auxiliary signal into a second signal in accordance with the control characteristic. The updating unit is configured to update the control characteristic so that an evaluation function based on the error signal and a second auxiliary signal is minimized, the second auxiliary signal being a difference between the second signal and the first signal.

In the following embodiments, two methods (a first method and a second method) for relaxing the constraint of the above-described slow adaptation limit in a case where the distance between the control loudspeaker and the error microphone is long will be described. In the first method, a characteristic obtained by processing the estimated secondary path characteristic is introduced, which is referred to as a processed secondary path characteristic. In the second method, a new update rule is introduced by changing the evaluation function. The first embodiment corresponds to a case where the first method is applied to the feedforward system. The second embodiment corresponds to a case where the first method is applied to the adaptive feedback system. The third embodiment corresponds to a case where the second method is applied to the feedforward system. The fourth embodiment corresponds to a case where the second method is applied to the adaptive feedback system.

First Embodiment

Figure 1:
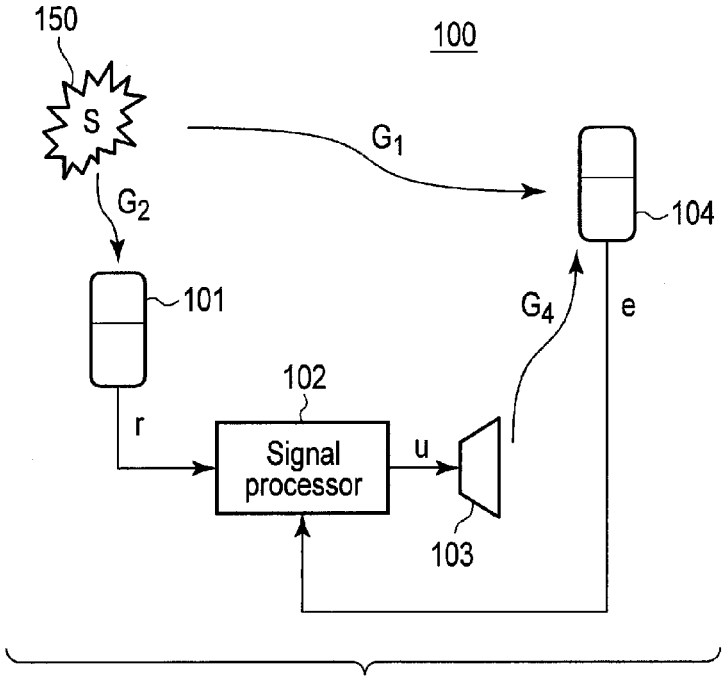
FIG. 1 is a schematic view showing a feedforward active noise-reduction apparatus according to the first and third embodiments.

FIG. 1 schematically shows a feedforward active noise-reduction apparatus 100 according to the first embodiment. The active noise-reduction apparatus 100 outputs a sound having the same amplitude as that of noise generated by a noise source 150 but an opposite phase, thereby reducing the noise in the space. More specifically, as shown in FIG. 1, the active noise-reduction apparatus 100 includes a reference microphone 101, a signal processor 102, a control loudspeaker 103, and an error microphone 104.

The reference microphone 101 converts noise generated by the noise source 150 into a reference signal r. For example, the reference microphone 101 detects the sound pressure of the noise generated by the noise source 150, and outputs the detection signal as the reference signal r. An analog/digital converter (not shown) is provided between the reference microphone 101 and the signal processor 102. The reference signal r is converted into a digital signal by the analog/digital converter and given to the signal processor 102. The signal processor 102 filters the reference signal r using a control filter 202 (shown in FIG. 2) having a control characteristic K, thereby generating a control signal u used to cancel the noise. A digital/analog converter (not shown) is provided between the signal processor 102 and the control loudspeaker 103. The control signal u is converted into an analog signal by the digital/analog converter and given to the control loudspeaker 103.

The control loudspeaker 103 emits a control sound in the space based on the control signal u. The error microphone 104 converts the sound in the space, including the noise from the noise source 150 and the control sound from the control loudspeaker 103, into an error signal e. For example, the error microphone 104 detects the combined sound pressure of the noise from the noise source 150 and the control sound from the control loudspeaker 103, and generates the error signal e representing the detected combined sound pressure. An analog/digital converter (not shown) is provided between the error microphone 104 and the signal processor 102. The error signal e is converted into a digital signal by this analog/digital converter and given to the signal processor 102. The signal processor 102 adaptively controls the control filter 202 based on the error signal e. More specifically, the signal processor 102 updates the control filter 202 so that an evaluation function based on the error signal e is minimized.

The active noise-reduction apparatus 100 according to this embodiment cancels the noise from the noise source 150 by the control sound from the control loudspeaker 103, thereby effectively reducing the noise in the target area (more specifically, the installation position of the error microphone 104) of the space. A sound such as noise to be reduced will also be referred to as a target sound. In this embodiment, the target sound is directed to, for example, a periodic signal (periodic noise) such as a sinusoidal signal. A period T of the periodic signal is assumed to be known.

Referring to FIG. 1, a spatial transfer function (primary path characteristic) from the noise source 150 to the error microphone 104 is represented by $G_1$, a spatial transfer function from the noise source 150 to the reference microphone 101 is represented by $G_2$, and a spatial transfer function (secondary path characteristic) from the control loudspeaker 103 to the error microphone 104 is represented by $G_4$.

Figure 2:
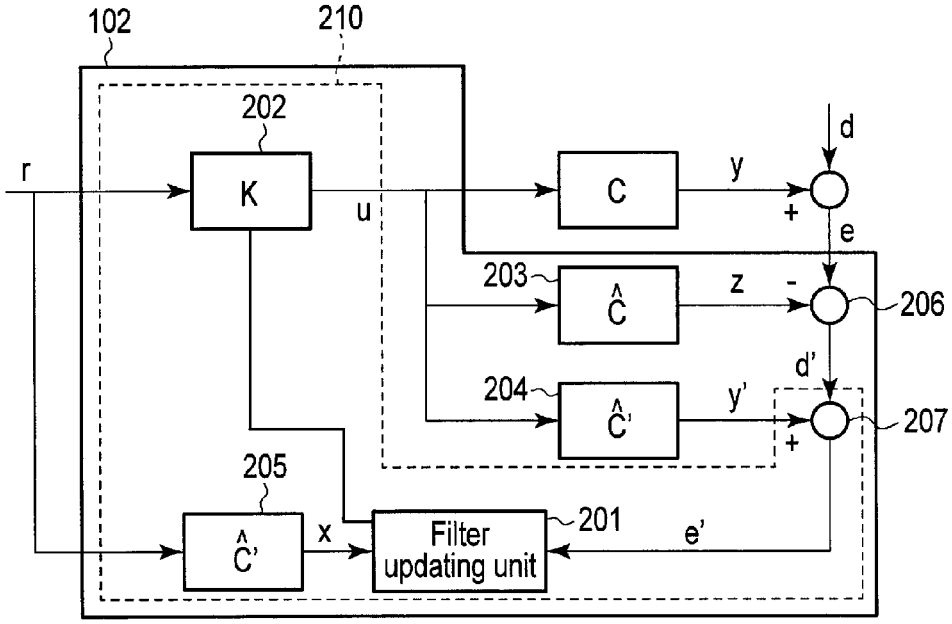
FIG. 2 is a schematic view showing a signal processor according to the first embodiment.

FIG. 2 schematically shows the signal processor 102 according to this embodiment. As shown in FIG. 2, the signal processor 102 includes a filter updating unit 201, the control filter 202, a control effect estimation filter 203, a control effect estimation filter 204, a secondary path filter 205, an adder (to be also referred to as an estimated noise signal generator) 206, and an adder 207. The filter updating unit 201, the control filter 202, the secondary path filter 205, and the adder 207 form a control signal generator 210.

Referring to FIG. 2, a signal y is obtained by causing the error microphone 104 to receive the control sound from the control loudspeaker 103. A signal d is obtained by causing the error microphone 104 to receive the noise from the noise source 150. The sum of the signals y and d is the error signal e.

In the signal processor 102, the reference signal r is given to the control filter 202 and the secondary path filter 205. The control filter 202 converts the reference signal r into the control signal u in accordance with the control characteristic K. The control effect estimation filter 203 converts the control signal u into a signal z in accordance with an estimated secondary path characteristic $\hat{C}$. The estimated secondary path characteristic $\hat{C}$ is generated based on a result of identifying the secondary path characteristic C (corresponding to $G_4$ in FIG. 1) in advance. The signal z represents a value obtained by estimating, based on the estimated secondary path characteristic $\hat{C}$, the sound that reaches the error microphone 104 from the control loudspeaker 103. The adder 206 subtracts the signal z from the error signal e, thereby generating an estimated noise signal d'.

The control effect estimation filter 204 converts the control signal u into a signal y' in accordance with a processed secondary path characteristic $\hat{C}'$. The processed secondary path characteristic $\hat{C}'$ is obtained by virtually shortening the delay in the secondary path characteristic. More specifically, the processed secondary path characteristic $\hat{C}'$ is obtained by shifting the estimated secondary path characteristic $\hat{C}$ leftward by T×m in an impulse response, that is, by processing the estimated secondary path characteristic $\hat{C}$ so as to shorten the delay included in the estimated secondary path characteristic $\hat{C}$ by the time T×m. The value m is a positive integer satisfying T×m≤a where a is a delay corresponding to the distance between the control loudspeaker 103 and the error microphone 104. In this case, the delay in the processed secondary path characteristic $\hat{C}'$ is (a−T×m). The delay a is obtained by measurement. The signal y' represents a value obtained by estimating, based on the processed secondary path characteristic $\hat{C}'$, the sound that reaches the error microphone 104 from the control loudspeaker 103. Note that in this embodiment, a maximum integer satisfying T×m≤a is used as the value m to make the shift amount closest to the delay a. As the value m, for example, a predetermined value is usable.

The adder 207 adds the signal y' to the estimated noise signal d', thereby generating an error signal e'. The secondary path filter 205 converts the reference signal r into an auxiliary signal x in accordance with the processed secondary path characteristic $\hat{C}'$.

The filter updating unit 201 updates the control characteristic K of the control filter 202 so that the error signal e' from the adder 207 is minimized. More specifically, the filter updating unit 201 updates the control characteristic K of the control filter 202 so as to minimize an evaluation function based on the error signal e', which is represented by, for example, $$J=e'(n)^2 \tag{8}$$

An update rule derived based on the evaluation function represented by equation (8) can be given by $$\theta_K(n+1)=\theta_K(n)-2\mu e'(n)\psi(n) \tag{9}$$

$$\psi(n)=\left[\sum_{i=0}^{CL-1}\theta_{\hat{C}'(i)}r(n-i-0),\ \ldots\ ,\ \sum_{i=0}^{CL-1}\theta_{\hat{C}'(i)}r(n-i-(KL-1))\right]^T$$

$$\theta_{\hat{C}'}=\left[\theta_{\hat{C}'(0)},\theta_{\hat{C}'(1)},\ \cdots\ ,\theta_{\hat{C}'(CL-1)}\right]^T$$

where ψ(n) is the time series data of the auxiliary signal x output from the secondary path filter 205. That is, the filter updating unit 201 updates the control filter 202 using the error signal e' from the adder 207 and the auxiliary signal x from the secondary path filter 205 in accordance with, for example, equations (9).

The update rule based on NLMS updating is given by $$\theta_K(n+1)=\theta_K(n)-\frac{2\mu}{|\psi(n)|^2+\beta}e'(n)\psi(n) \tag{10}$$

The target sound of this embodiment is periodic noise. Hence, in the steady state, the output obtained by converting the reference signal r in accordance with the estimated secondary path characteristic $\hat{C}$ equals the output obtained by converting the reference signal r in accordance with the processed secondary path characteristic $\hat{C}'$. That is, $$\sum_{i=0}^{CL-1}\theta_{\hat{C}(i)}r(n-i)=\sum_{i=0}^{CL-1}\theta_{\hat{C}'(i)}r(n-i) \tag{11}$$

holds. Strictly speaking, equation (11) holds after the elapse of taps corresponding to CL from the start of control.

Similarly, in the steady state, since the signals z and y' are equal, the error signals e and e' are equal as well. Hence, minimizing the error signal e' is equivalent to minimizing the error signal e.

In this embodiment, the control filter 202 is updated based on the processed secondary path characteristic $\hat{C}'$. The output y' of the control effect estimation filter 204 is given by $$y'(n) = \sum_{i=0}^{CL-1} \theta_{\hat{C}'(i)} \left\{ \sum_{j=0}^{KL-1} \theta_{K(j)}(n-i) r(n-i-j) \right\} \tag{12}$$

The approximation of y' obtained by changing the order of convolution is given by $$y'(n) \cong \sum_{j=0}^{KL-1} \theta_{K(j)}(n) \left\{ \sum_{i=0}^{CL-1} \theta_{\hat{C}'(i)} r(n-i-j) \right\} \tag{13}$$

In the signal y'(n), the influence of the control filter 202 before K(n−(a−T×m)) is reflected. This is closer to K(n) than in the conventional method using normal Filtered-x LMS. For this reason, the constraint of the slow adaptation limit by the change of the convolution order is relaxed. That is, since the control filter 202 is updated using the processed secondary path characteristic in which the delay a in the estimated secondary path characteristic is changed to the delay (a-T×m), the difference between equation (12) and equation (13) is smaller than the difference between equation (6) and equation (7). Hence, the constraint of the slow adaptation limit by the change of the convolution order is relaxed.

The method according to this embodiment is applicable to noise having periodicity such as periodic noise but not to white noise and the like. Note that the target sound may include aperiodic noise together with the periodic noise. In this case as well, only the periodic noise can be reduced. The control effect can further be improved using, for example, a linear prediction filter that extracts components associated with the periodic noise from the reference signal.

This embodiment is adaptable not only when the period of the periodic noise is known but also when the period of the periodic noise is not known in advance.

Figure 3:
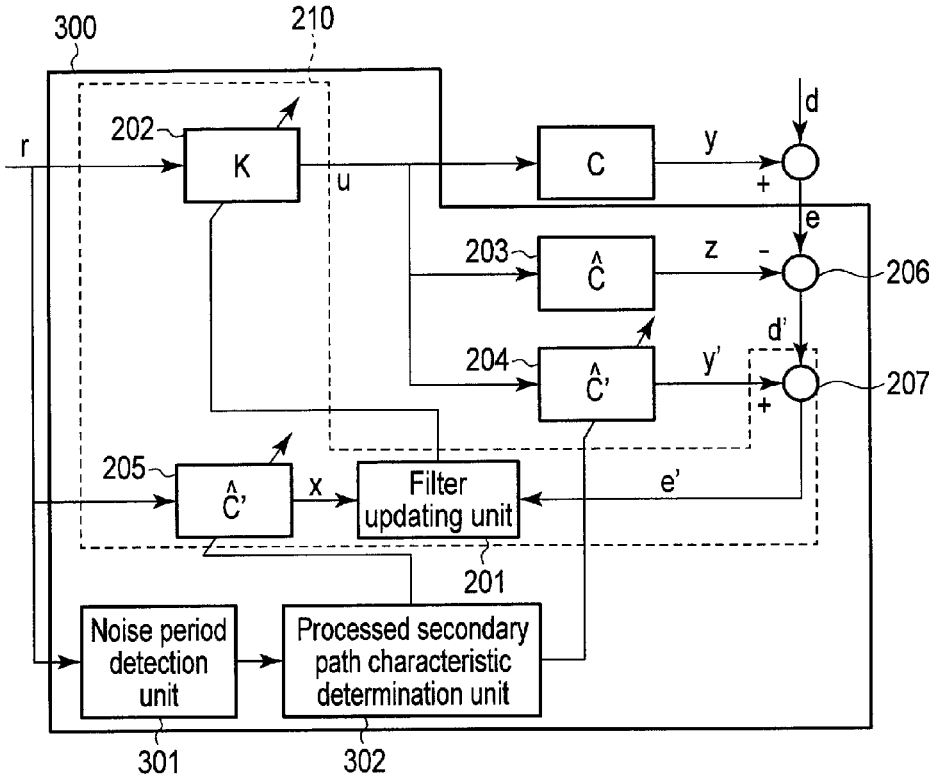
FIG. 3 is a schematic view showing a signal processor according to a modification of the first embodiment.

FIG. 3 schematically shows a signal processor 300 of an active noise-reduction apparatus according to a modification of the first embodiment. The active noise-reduction apparatus according to the modification of the first embodiment has the same device arrangement as the active noise-reduction apparatus 100 shown in FIG. 1. The signal processor 300 shown in FIG. 3 includes a noise period detection unit 301 and a processed secondary path characteristic determination unit 302 in addition to the components of the signal processor 102 shown in FIG. 2.

The noise period detection unit 301 detects the period of noise based on the reference signal r. For example, the noise period detection unit 301 calculates an autocorrelation coefficient based on the reference signal r, and calculates the period T of the noise based on the calculated autocorrelation coefficient. The processed secondary path characteristic determination unit 302 determines the processed secondary path characteristic $\hat{C}'$ based on the period T calculated by the noise period detection unit 301. More specifically, the processed secondary path characteristic determination unit 302 processes the estimated secondary path characteristic a such that the delay changes to (a−T×m), thereby generating the processed secondary path characteristic $\hat{C}'$. Note that the method of calculating the period of noise is not limited to the method based on the autocorrelation coefficient and may be implemented by another method.

The active noise-reduction apparatus according to the modification of the first embodiment can reduce noise even when the period of the noise changes along with the elapse of time.

As described above, the active noise-reduction apparatus according to this embodiment can relax the influence of the change of the convolution order by updating the control filter using the processed secondary path characteristic obtained by virtually shortening the delay in the secondary path characteristic. This makes it possible to increase the update rate and suppress the risk of divergence.

Second Embodiment

Figure 4:
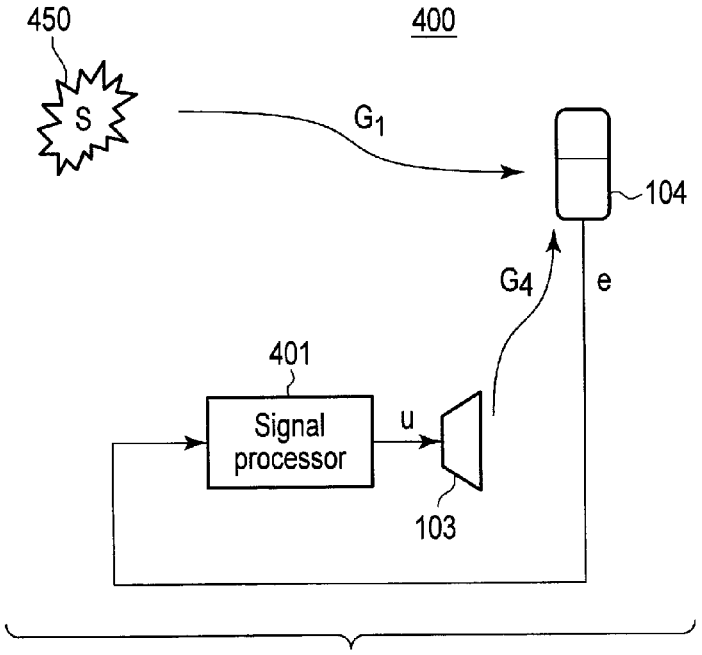
FIG. 4 is a schematic view showing an adaptive feedback active noise-reduction apparatus according to the second and fourth embodiments.

FIG. 4 schematically shows an adaptive feedback active noise-reduction apparatus 400 according to the second embodiment. As shown in FIG. 4, the active noise-reduction apparatus 400 includes a control loudspeaker 103, an error microphone 104, and a signal processor 401.

The error microphone 104 converts a sound in the space, including noise emitted by a noise source 450 and a control sound emitted by the control loudspeaker 103, into an error signal e. For example, the error microphone 104 detects the combined sound pressure of the noise from the noise source 450 and the control sound from the control loudspeaker 103, and generates the error signal e representing the detected combined sound pressure. An analog/digital converter (not shown) is provided between the error microphone 104 and the signal processor 401. The error signal e is converted into a digital signal by the analog/digital converter and given to the signal processor 401.

The signal processor 401 generates a control signal u based on the error signal e. More specifically, the signal processor 401 adaptively controls a control filter 502 (shown in FIG. 5), and generates the control signal u. A digital/analog converter (not shown) is provided between the signal processor 401 and the control loudspeaker 103. The control signal u is converted into an analog signal by the digital/analog converter and given to the control loudspeaker 103. The control loudspeaker 103 emits a control sound in the space based on the control signal u.

Figure 5:
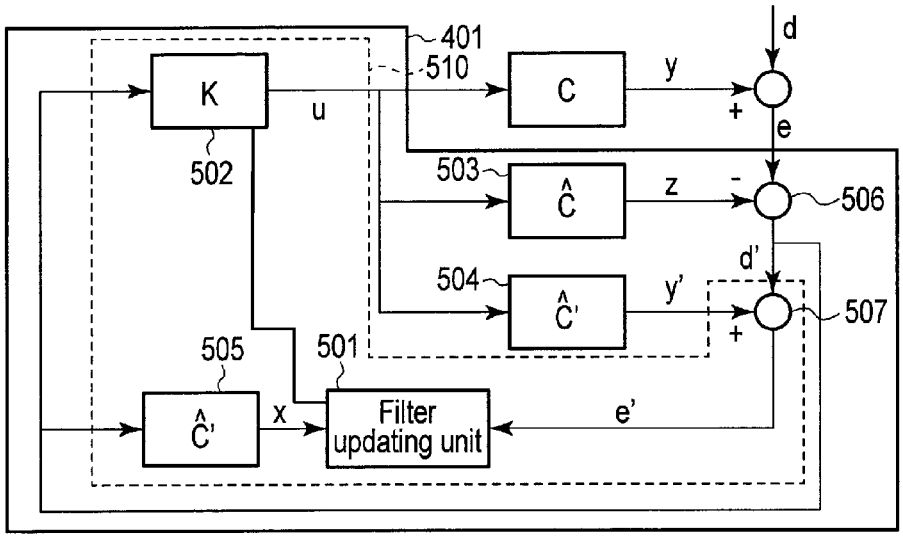
FIG. 5 is a schematic view showing a signal processor according to the second embodiment.

FIG. 5 schematically shows the signal processor 401 according to this embodiment. The signal processor 401 includes a filter updating unit 501, the control filter 502, a control effect estimation filter 503, a control effect estimation filter 504, a secondary path filter 505, an adder (to be also referred to as an estimated noise signal generator) 506, and an adder 507. The filter updating unit 501, the control filter 502, the secondary path filter 505, and the adder 507 form a control signal generator 510. The control effect estimation filter 503, the control effect estimation filter 504, the adder 506, and the adder 507 perform the same operations as the control effect estimation filter 203, the control effect estimation filter 204, the adder 206, and the adder 207, respectively, and a description thereof will appropriately be omitted.

In this embodiment, an estimated noise signal d' is given to the adder 507 and is also given to the control filter 502 and the secondary path filter 505. The control filter 502 converts the estimated noise signal d' from the adder 506 into the control signal u in accordance with a control characteristic K. The secondary path filter 505 converts the estimated noise signal d' from the adder 506 into an auxiliary signal x in accordance with a processed secondary path characteristic Ĉ'.

The filter updating unit 501 updates the control characteristic K of the control filter 502 so that an error signal e' from the adder 507 is minimized. More specifically, the filter updating unit 501 updates the control filter 502 using the error signal e' from the adder 507 and the auxiliary signal x from the secondary path filter 505 in accordance with, for example, equations (9). In this embodiment, however, time series data ψ(n) of the auxiliary signal x is given by $$\psi(n) = \left[\sum_{i=0}^{CL-1} \theta_{\hat{C}'(i)} d'(n-i-0), \ldots, \sum_{i=0}^{CL-1} \theta_{\hat{C}'(i)} d'(n-i-(KL-1))\right]^T \quad (14)$$

This embodiment is adaptable not only when the period of the periodic noise is known but also when the period of the periodic noise is not known in advance.

Figure 6:
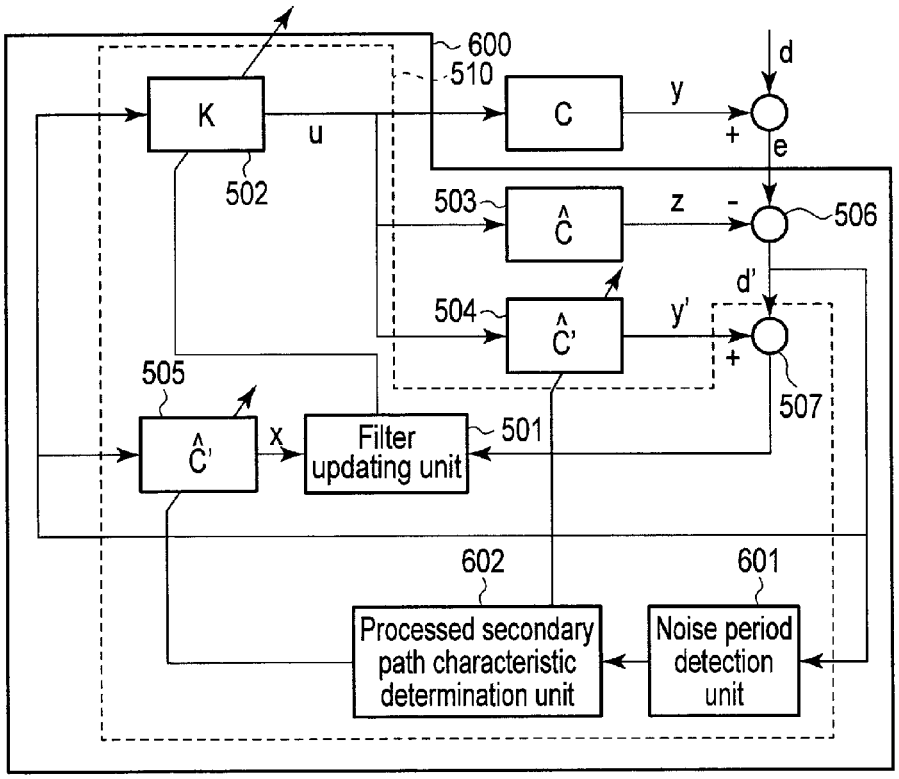
FIG. 6 is a schematic view showing a signal processor according to a modification of the second embodiment.

FIG. 6 schematically shows a signal processor 600 of an active noise-reduction apparatus according to a modification of the second embodiment. The active noise-reduction apparatus according to the modification of the second embodiment has the same device arrangement as the active noise-reduction apparatus 400 shown in FIG. 4. The signal processor 600 shown in FIG. 6 includes a noise period detection unit 601 and a processed secondary path characteristic determination unit 602 in addition to the components of the signal processor 401 shown in FIG. 5.

The noise period detection unit 601 detects the period of noise based on the estimated noise signal d'. For example, the noise period detection unit 601 calculates an autocorrelation coefficient based on the estimated noise signal d', and calculates a period T of the noise based on the calculated autocorrelation coefficient. The processed secondary path characteristic determination unit 602 determines the processed secondary path characteristic Ĉ' based on the period T calculated by the noise period detection unit 601. More specifically, the processed secondary path characteristic determination unit 602 processes an estimated secondary path characteristic a such that the delay changes to (a−T×m), thereby generating the processed secondary path characteristic Ĉ'. Note that the method of calculating the period of noise is not limited to the method based on the autocorrelation coefficient and may be implemented by another method.

The active noise-reduction apparatus according to the modification of the second embodiment can reduce noise even when the period of the noise changes along with the elapse of time.

As described above, the active noise-reduction apparatus according to this embodiment can relax the influence of the change of the convolution order by updating the control filter using the processed secondary path characteristic obtained by virtually shortening the delay in the secondary path characteristic. This makes it possible to increase the update rate and suppress the risk of divergence.

Third Embodiment

An active noise-reduction apparatus according to the third embodiment has the same device arrangement as the active noise-reduction apparatus 100 (FIG. 1) according to the first embodiment. The third embodiment is different from the first embodiment in the arrangement of a signal processor. In this embodiment, a description of the same parts as in the first embodiment will appropriately be omitted. In this embodiment, a target sound is not limited to periodic noise but is directed to arbitrary noise.

Figure 7:
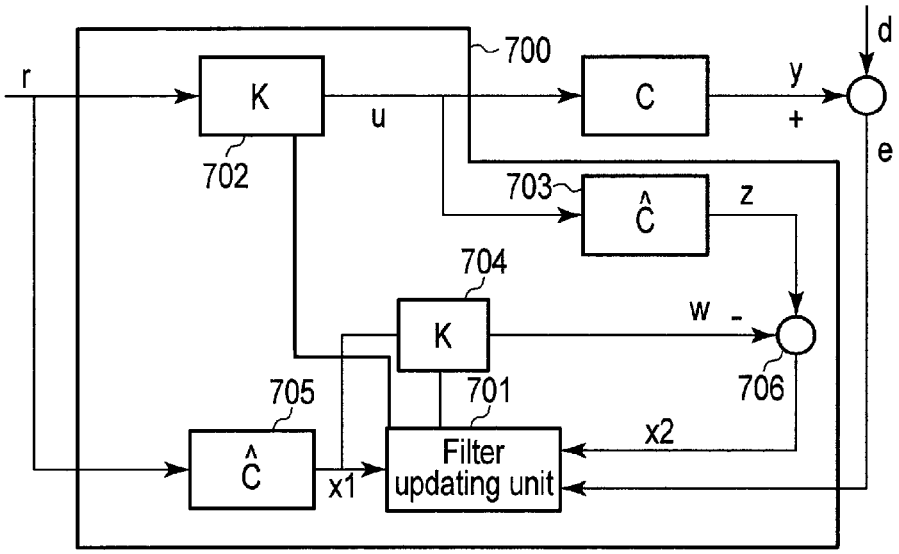
FIG. 7 is a schematic view showing a signal processor according to the third embodiment.

FIG. 7 schematically shows a signal processor 700 of an active noise-reduction apparatus according to the third embodiment. As shown in FIG. 7, the signal processor 700 includes a filter updating unit 701, a control filter 702, a control effect estimation filter 703, a virtual control effect estimation filter 704, a secondary path filter 705, and an adder 706. The control filter 702, the control effect estimation filter 703, and the secondary path filter 705 perform the same operations as the control filter 202, the control effect estimation filter 203, and the secondary path filter 205.

In the signal processor 700, a reference signal r generated by a reference microphone 101 is given to the control filter 702 and the secondary path filter 705. The control filter 702 converts the reference signal r into a control signal u in accordance with a control characteristic K. The control signal u is output from a control loudspeaker 103 as a control sound and also given to the control effect estimation filter 703. The control effect estimation filter 703 converts the control signal u into a signal z in accordance with an estimated secondary path characteristic Ĉ. The signal z is given to the adder 706.

The secondary path filter 705 converts the reference signal r into an auxiliary signal x1 in accordance with the estimated secondary path characteristic Ĉ. The auxiliary signal x1 is given to the filter updating unit 701 and the virtual control effect estimation filter 704. The virtual control effect estimation filter 704 estimates the control effect assuming that the characteristic K of the control filter 702 is always the characteristic of the current time. More specifically, the virtual control effect estimation filter 704 converts the auxiliary signal x1 into a signal w in accordance with the control characteristic K. The adder 706 subtracts the signal w from the signal z, thereby generating an auxiliary signal x2. The filter updating unit 701 updates the control filter 702 using the auxiliary signal x1 from the secondary path filter 705, the auxiliary signal x2 from the adder 706, and an error signal e from an error microphone 104.

In this embodiment, an update rule is derived based on an evaluation function represented by $$J(n)=e(n)^2+(z(n)-w(n))^2 \quad (15)$$

The signal z(n) is obtained by estimating, based on the estimated secondary path characteristic Ĉ, the signal that reaches the error microphone 104 from the control loudspeaker 103. The control characteristic before not K(n) but K(n−a) is reflected on the signal z(n). Hence, the partial differentiation of z(n) concerning K(n) is 0, as indicated by $$\left(\frac{\partial z(n)}{\partial \theta_K}\right)_{\theta_K=\theta_K(n)} = 0 \quad (16)$$

In addition, since w(n) is given by $$w(n)=\psi(n)^T\theta_K(n) \quad (17)$$

the partial differentiation of w(n) concerning K(n) is given by $$\psi(n) = \left[\sum_{i=0}^{CL-1} \theta_{\hat{C}(i)} r(n-i-0), \ldots, \sum_{i=0}^{CL-1} \theta_{\hat{C}(i)} r(n-i-(KL-1))\right]^T \quad (18)$$

-continued $$\left(\frac{\partial w(n)}{\partial \theta_K}\right)_{\theta_K=\theta_K(n)} = \psi(n)$$

The instantaneous gradient of the evaluation function represented by equation (15) is obtained by $$\left(\frac{\partial J(n)}{\partial \theta_K}\right)_{\theta_K=\theta_K(n)} = 2e(n)\psi(n) + 2(z(n) - w(n))(-\psi(n)) \tag{19}$$

where ψ(n) is time series data of the auxiliary signal x1 output from the secondary path filter 705. The instantaneous gradient of the square of the error signal e is obtained by changing the order of convolution, like equations (2).

Hence, the update rule based on LMS is derived by $$\theta_K(n+1)=\theta_K(n)-2\mu(e(n)-(z(n)-w(n))\psi(n) \tag{20}$$

In addition, the update rule based on NLMS is derived by $$\theta_K(n+1) = \theta_K(n) - \frac{2\mu}{|\psi|^2 + \beta}(e(n) - (z(n) - w(n)))\psi(n) \tag{21}$$

The filter updating unit 701 updates the control characteristic K of the control filter 702 in accordance with, for example, equation (20) or (21).

In the active noise-reduction apparatus according to the third embodiment, the evaluation function incorporates the difference between the signal z and the signal w. When the difference becomes large, the update rate automatically decreases to suppress divergence. Suppressing the difference between the signal z and the signal w is equivalent to suppressing the difference between equation (6) and equation (7) (changing d' in equations (6) and (7) to r). This means that the constraint of the slow adaptation limit generated by changing the convolution order can be relaxed. Since the step size can be set to a large value, the update rate increases.

Fourth Embodiment

An active noise-reduction apparatus according to the fourth embodiment has the same device arrangement as the active noise-reduction apparatus 400 (FIG. 4) according to the second embodiment. The fourth embodiment is different from the second embodiment in the arrangement of a signal processor. In this embodiment, a description of the same parts as in the second embodiment will appropriately be omitted.

Figure 8:
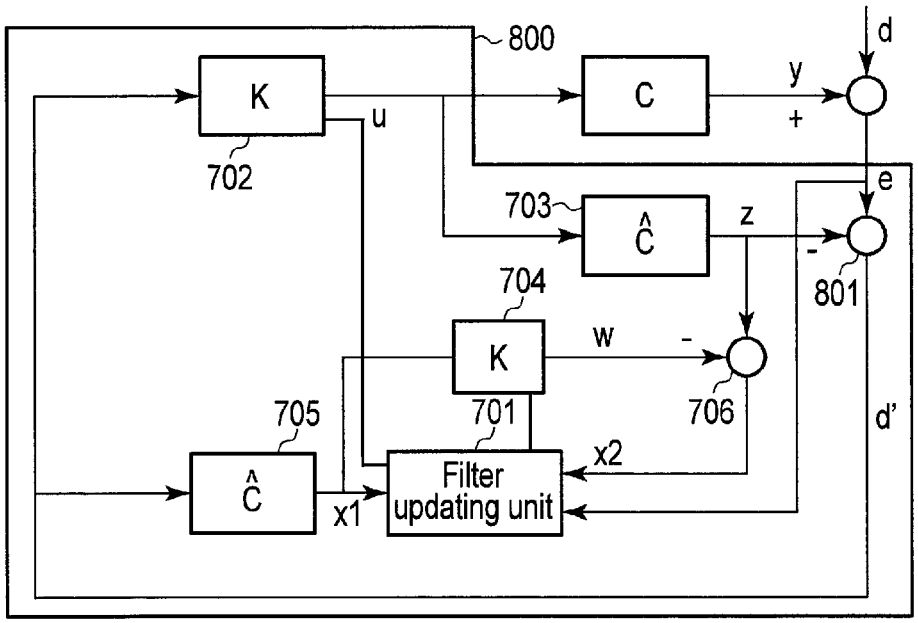
FIG. 8 is a schematic view showing a signal processor according to the fourth embodiment.

FIG. 8 schematically shows a signal processor 800 of an active noise-reduction apparatus according to the fourth embodiment. As shown in FIG. 8, the signal processor 800 includes a filter updating unit 701, a control filter 702, a control effect estimation filter 703, a virtual control effect estimation filter 704, a secondary path filter 705, an adder 706, and an adder 801.

The adder 801 subtracts a signal z from the control effect estimation filter 703 from an error signal e from an error microphone 104, thereby generating an estimated noise signal d'. In the fourth embodiment, the estimated noise signal d' is given to the control filter 702 and the secondary path filter 705 in place of the reference signal r of the third embodiment. In other words, in the fourth embodiment, the adder 801 generates the estimated noise signal d' as a reference signal to be given to the control filter 702 and the secondary path filter 705.

The control filter 702 converts the estimated noise signal d' into a control signal u in accordance with a control characteristic K. The control signal u is output from a control loudspeaker 103 as a control sound and also given to the control effect estimation filter 703. The control effect estimation filter 703 converts the control signal u into a signal z in accordance with an estimated secondary path characteristic $\hat{C}$. The signal z is given to the adder 706 and the adder 801.

The secondary path filter 705 converts the estimated noise signal d' into an auxiliary signal x1 in accordance with the estimated secondary path characteristic $\hat{C}$. The auxiliary signal x1 is given to the filter updating unit 701 and the virtual control effect estimation filter 704. The virtual control effect estimation filter 704 converts the auxiliary signal x1 into a signal w in accordance with the control characteristic K. The adder 706 subtracts the signal w from the signal z, thereby generating an auxiliary signal x2.

The filter updating unit 701 updates the control filter 702 using the auxiliary signal x1 from the secondary path filter 705, the auxiliary signal x2 from the adder 706, and the error signal e from the error microphone 104. More specifically, the filter updating unit 701 updates the control characteristic K of the control filter 702 in accordance with, for example, equation (20) or (21). In this embodiment, however, time series data ψ(n) of the auxiliary signal x1 output from the secondary path filter 705 can be given by $$\psi(n) = \left[\sum_{i=0}^{CL-1} \theta_{\hat{C}(i)} d'(n-i-0), \ldots, \sum_{i=0}^{CL-1} \theta_{\hat{C}(i)} d'(n-i-(KL-1))\right]^T \tag{22}$$

In the active noise-reduction apparatus according to the fourth embodiment, the evaluation function incorporates the difference between the signal z and the signal w. When the difference becomes large, the update rate automatically decreases to suppress divergence. In addition, since the step size can be set to a large value, the update rate increases. However, the target sound is fundamentally limited to periodic noise.

The first method described in the first and second embodiments and the second method described in the third and fourth embodiments can be used in combination.

An active noise-reduction apparatus according to at least one of the above-described embodiments can relax the constraint of the slow adaptation limit and effectively reduce noise. An active noise-reduction apparatus according to at least one of the above-described embodiments is applicable to, for example, road noise-reduction in a vehicle, noise-reduction in medical equipment (for example, MRI), and a noise canceling earphone.

The present inventor conducted demonstrative experiments corresponding to adaptive feedback shown in FIG. 4 to be described next and verified that the active noise-reduction apparatuses according to the above-described embodiments are effective as compared to the conventional method.

Figure 9:
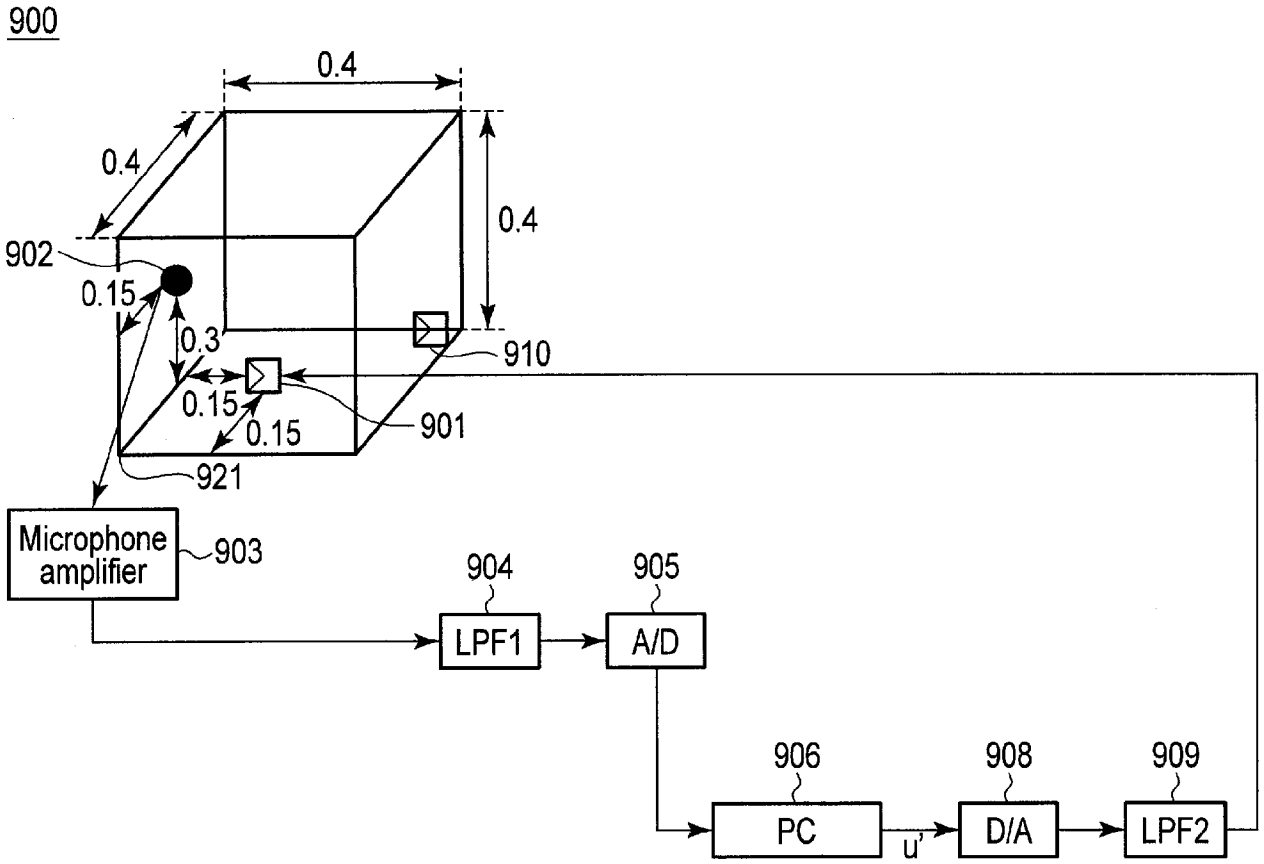
FIG. 9 is a view showing a demonstrative experimental environment.

FIG. 9 schematically shows a demonstrative experimental environment. In the demonstrative experiments, as shown in FIG. 9, a control loudspeaker 901, an error microphone 902, and a noise source (noise loudspeaker) 910 are arranged in an acrylic cubic box 900 having a side 0.4 meters long. Referring to FIG. 9, an XYZ coordinate system having an origin at a corner 921 of the box 900 is set. The noise source 910 is located at coordinates (0.4, 0.4, 0), the control loudspeaker 901 is located at coordinates (0.15, 0.15, 0), and the error microphone 902 is located at coordinates (0, 0.15, 0.3).

Noise is multichannel noise emitted by the noise loudspeaker (noise source) 910 and including sine waves of 200 Hz, 400 Hz, 600 Hz, 800 Hz, 1,000 Hz, 1,200 Hz, 1,400 Hz, and 1,600 Hz.

An error signal acquired by the error microphone 902 is amplified by a microphone amplifier 903, passed through a low pass filter (LPF) 904 serving as an antialiasing filter, converted into a digital signal by an analog/digital converter (A/D) 905, and given to a personal computer (PC) 906.

Assuming a case where the delay in the secondary path characteristic is long, the control signal u is delayed in the PC 906 to generate an input signal u' to the control loudspeaker 901. This delay is 305 taps. The signal u' is converted into an analog signal by a digital/analog converter (D/A) 908, passed through an LPF 909 serving as an interpolation filter, and given to the control loudspeaker 901.

The LPFs 904 and 909 are 2-KHz low-pass filters. The sampling frequency of the PC 906 is 10 KHz. When the sampling frequency of the PC 906 is 10 KHz, one tap is 0.1 msec. In addition, a bandpass filter of 150 Hz to 1,800 Hz is used as a control band adjustment filter (not shown) through which the error signal passes. In the demonstrative experiments, the active noise-reduction apparatus is implemented by the PC. However, instead of the PC a digital signal processor (DSP) may be used to conduct the demonstrative experiments.

Figure 10A:
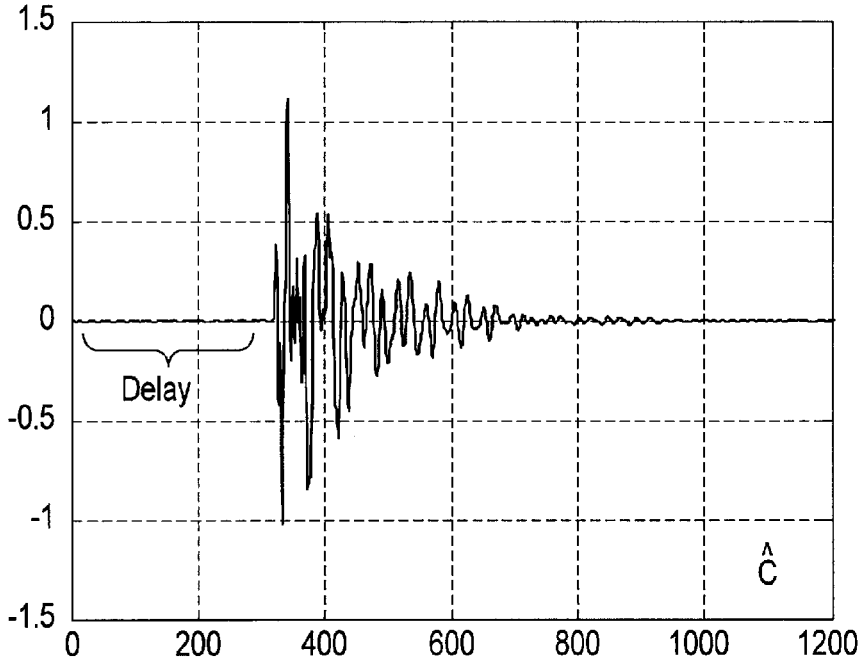
FIG. 10A is a graph showing an estimated secondary path characteristic.
Figure 10B:
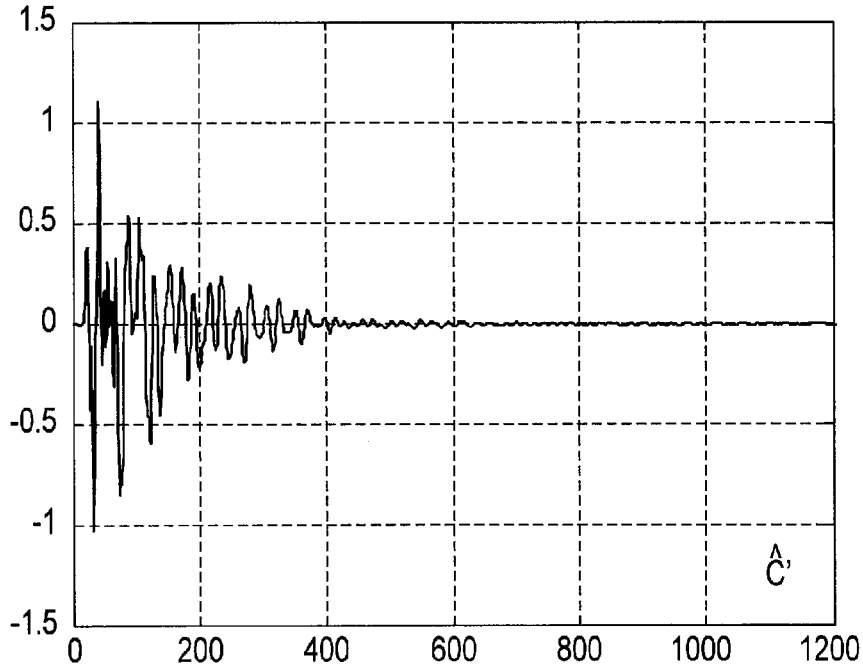
FIG. 10B is a graph showing a processed secondary path characteristic obtained by processing the estimated secondary path characteristic in FIG. 10A.

FIG. 10A shows the impulse response of the estimated secondary path characteristic $\hat{C}$ used in the demonstrative experiments. FIG. 10B shows the impulse response of the processed secondary path characteristic for demonstrative experiments associated with the first method. In FIGS. 10A and 10B, the transverse represents taps. The delay a in the secondary path characteristic is 315 taps (31.5 msec), and a noise period T1 is 50 taps (5 msec). Hence, the maximum integer m that satisfies $T1 \times m \leq a$ is 6. The processed secondary path characteristic is a characteristic obtained by shifting the estimated secondary path characteristic leftward by 300 taps ($T1 \times m$). That is, the delay in the secondary path characteristic is 15 taps.

Figures 11, 12:
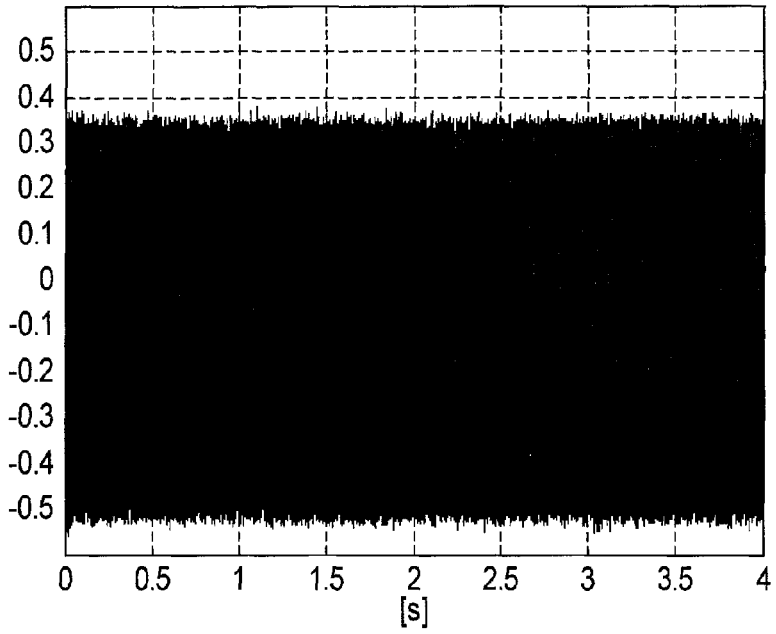
FIG. 11 is a graph showing the waveform of noise used in demonstrative experiments.
FIG. 12 is a table showing the results of demonstrative experiments of a first method, a second method, and a conventional method.

FIG. 11 shows the waveform of the noise used in the demonstrative experiments. In the demonstrative experiments, control starts after the elapse of 4 sec from noise generation. Hence, the graphs of FIGS. 13A, 13B, 13C, 14A, 14B, 14C, 15A, 15B, 16, and 17 show waveforms after the start of control (that is, after the elapse of 4 sec).

FIG. 12 shows the results of demonstrative experiments using the method (conventional method) using normal Filtered-x LMS, the first method described in the second embodiment, and the second method described in the fourth embodiment. Update rules based on NLMS are used as the control filter update rules. Equation (5) is used in the conventional method, equation (10) is used in the first method, and equation (21) is used in the second method. In FIG. 12, "○" indicates convergence, and "X" indicates divergence. As is apparent from FIG. 12, the first method and the second method can set the step size to values larger than in the conventional method.

Figure 13A:
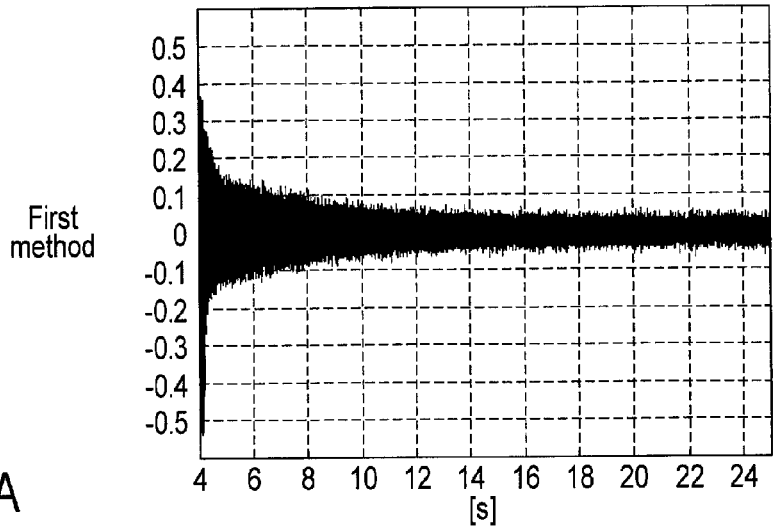
FIGS. 13A, 13B, and 13C are graphs showing the control results of the first method, the second method, and the conventional method when the step size is 0.005.
Figure 13B:
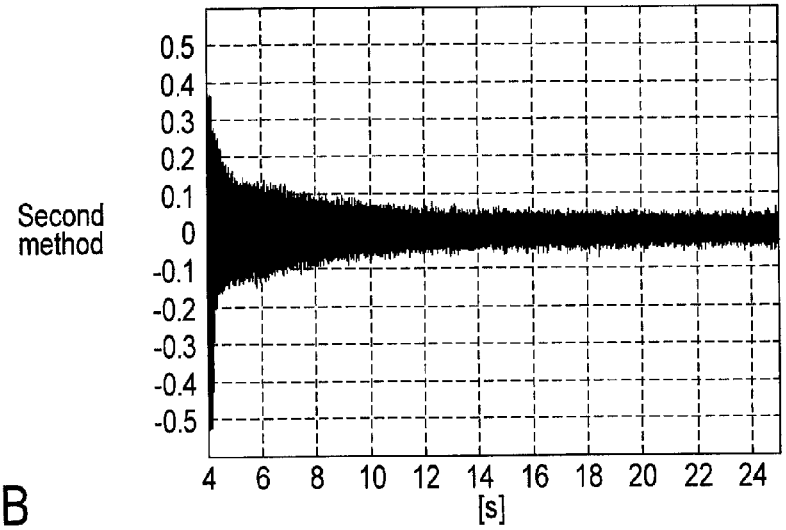
Figure 13C:
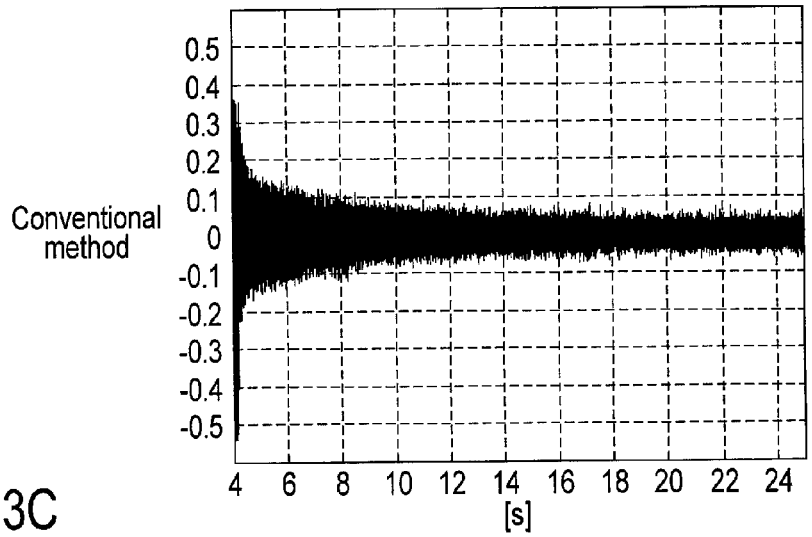

FIGS. 13A, 13B, and 13C respectively show the control results of the first method, the second method, and the conventional method when the step size was set to 0.005 (ID: a). As can be seen from FIGS. 13A, 13B, and 13C, stable control without divergence is possible in all of the first method, the second method, and the conventional method. However, since the step size is small, convergence is late and takes about 10 sec.

Figure 14A:
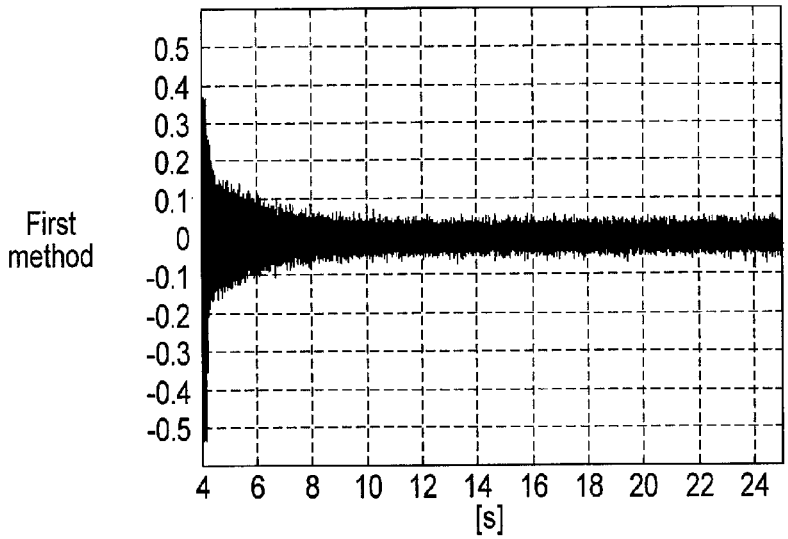
FIGS. 14A, 14B, and 14C are graphs showing the control results of the first method, the second method, and the conventional method when the step size is 0.01.
Figure 14B:
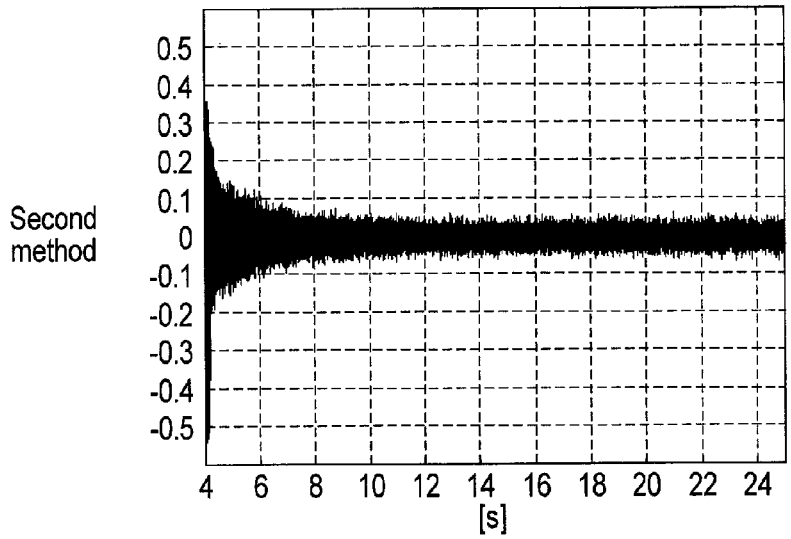
Figure 14C:
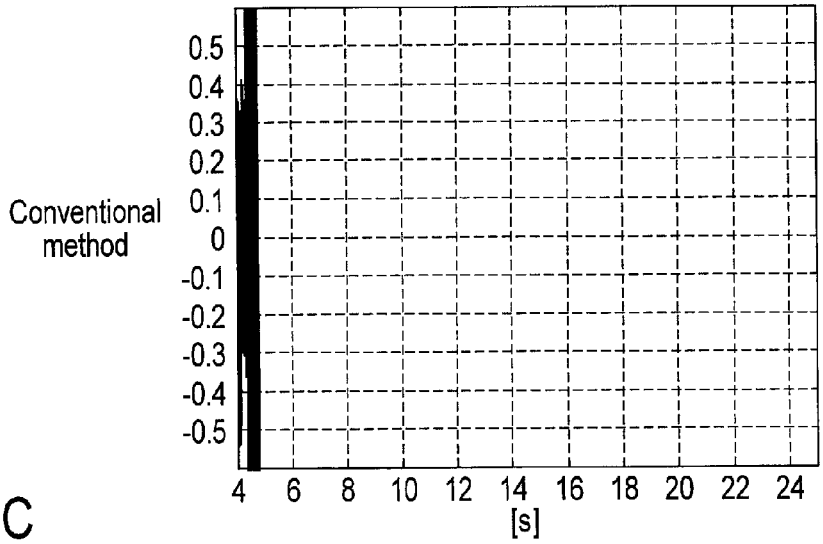

FIGS. 14A, 14B, and 14C respectively show the control results of the first method, the second method, and the conventional method when the step size was set to 0.01 (ID: b). As shown in FIGS. 14A and 14B, stable control is possible in the first method and the second method. In the conventional method, however, divergence occurs, as shown in FIG. 14C. In this case, in the first method and the second method, the time needed for convergence shortens as compared to the case where the step size is 0.005, and convergence occurs in about 6 sec.

Figure 15A:
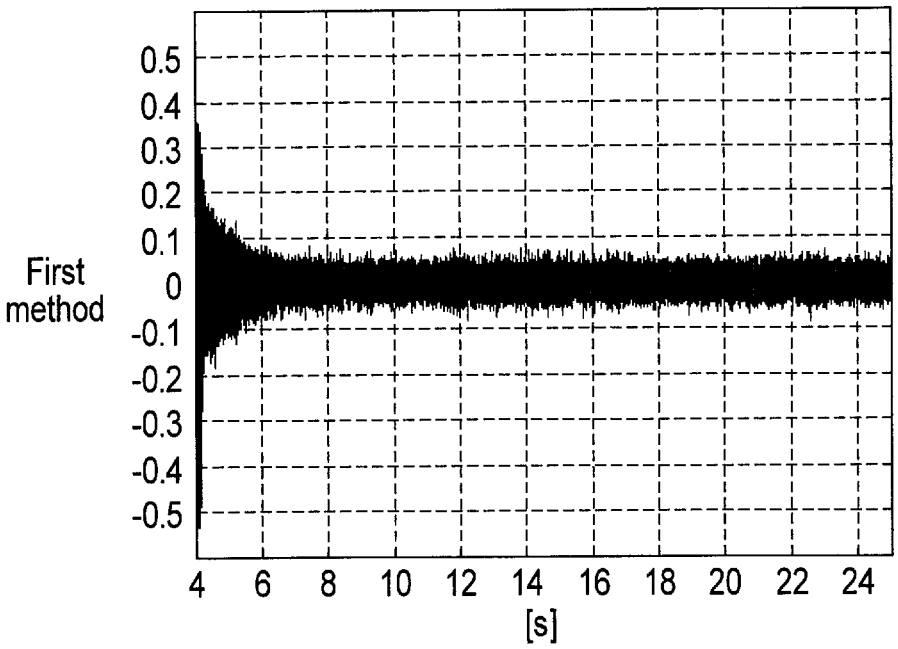
FIGS. 15A and 15B are graphs showing the control results of the first method and the second method when the step size is 0.02.
Figure 15B:
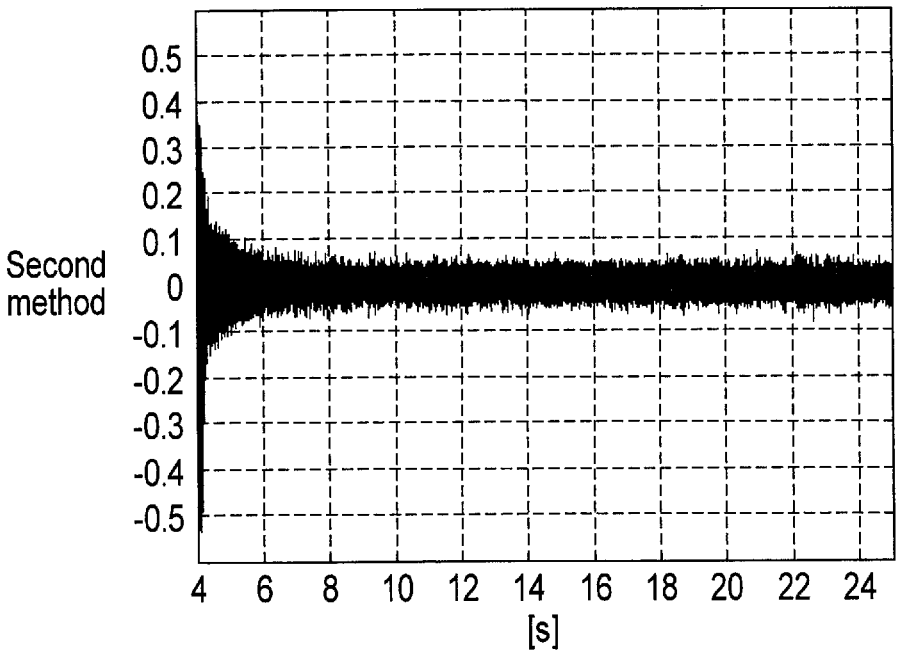

FIGS. 15A and 15B show the control results of the first method and the second method, respectively, when the step size was set to 0.02 (ID: d). In the first method and the second method, stable control is performed, and convergence occurs quickly as compared to the case where the step size is 0.01, as is apparent from FIGS. 15A and 15B.

Figure 16:
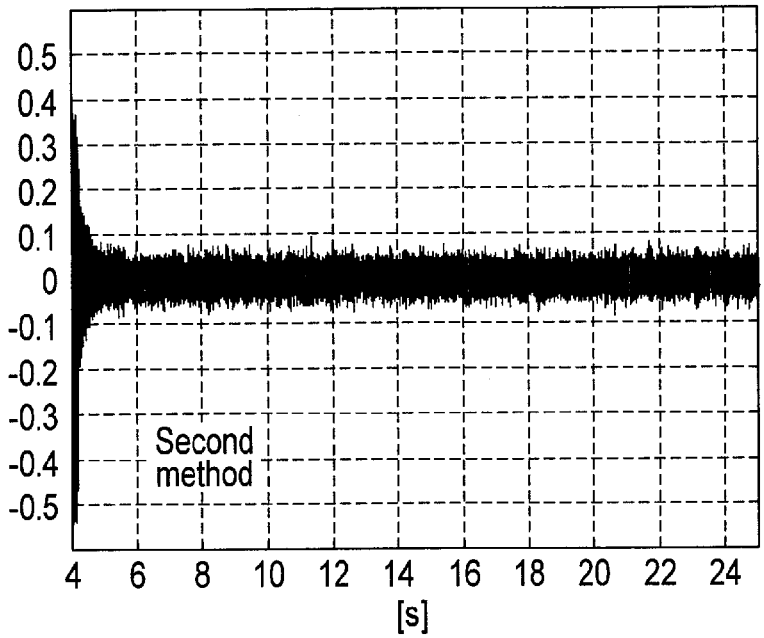
FIG. 16 is a graph showing, the control result of the second method when the step size is 0.05.

FIG. 16 shows the control result of the second method when the step size was set to 0.05 (ID: j). In the second method, stable control is performed, the convergence time shortens as compared to the case where the step size is 0.02, and the control effect is produced quickly in about 1 sec, as can be seen from FIG. 16.

Figure 17:
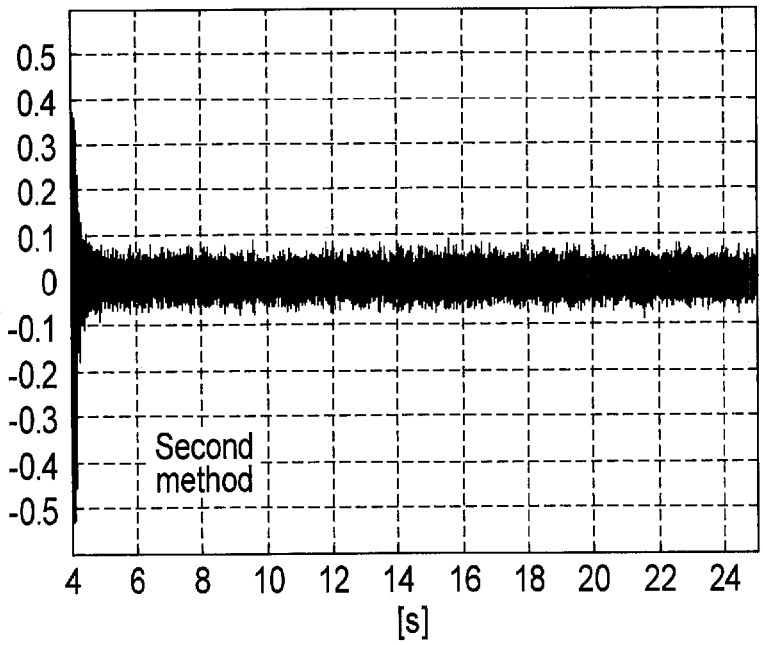
FIG. 17 is a graph showing the control result of the second method when the step size is 0.1.
Figure 18A:
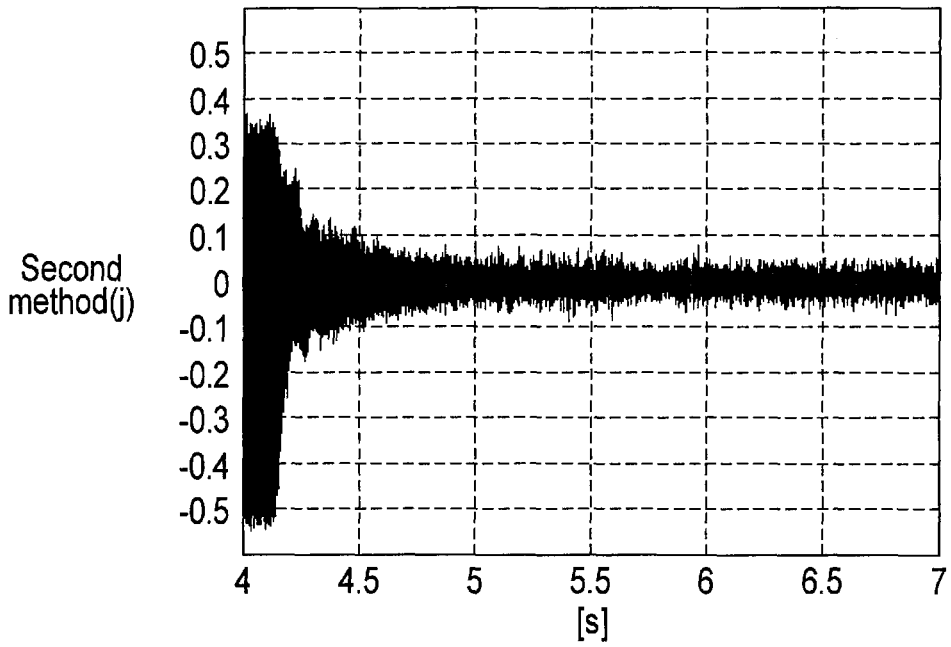
FIG. 18A is a graph showing a partially enlarged view of the control result shown in FIG. 16.
Figure 18B:
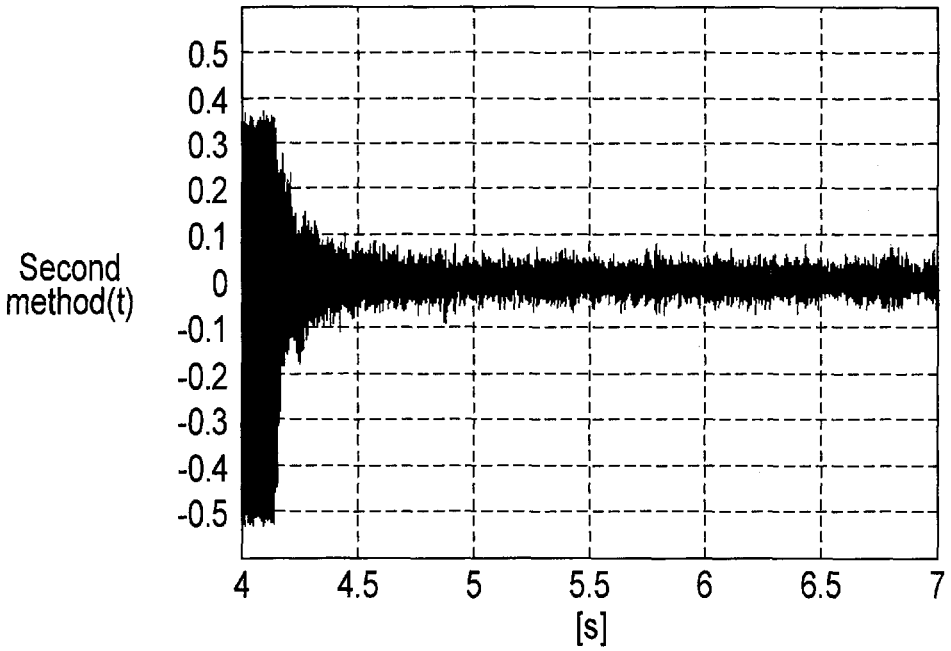
FIG. 18B is a graph showing a partially enlarged view of the control result shown in FIG. 17.

FIG. 17 shows the control result of the second method when the step size was set to 0.1 (ID: t). In the second method, stable control is performed, the convergence time shortens as compared to the case where the step size is 0.05, and the control effect is produced more quickly in about 0.5 sec, as can be seen from FIG. 17. FIG. 18A shows a partially enlarged view of the control result shown in FIG. 16 when the step size is 0.05. FIG. 18B shows a partially enlarged view of the control result shown in FIG. 17 when the step size is 0.1.

As is apparent from the above results, when the distance between the control loudspeaker and the error microphone is long, the first method can shorten the time until convergence to about ⅓ as compared to the conventional method, and the second method can more greatly shorten the time until convergence.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An active noise-reduction apparatus for reducing a target sound having periodicity, the apparatus comprising:

an error microphone which converts a sound including the target sound into a first error signal;

a reference signal generator configured to generate a reference signal;

a control filter configured to convert, in accordance with a control characteristic, the reference signal into a control signal used to cancel the target sound;

a control loudspeaker which emits a control sound based on the control signal;

a first control effect estimation filter configured to convert the control signal into a first signal in accordance with an estimated secondary path characteristic, the estimated secondary path characteristic being generated based on a result of identifying a secondary path characteristic from the control loudspeaker to the error microphone in advance;

an estimated noise signal generator configured to generate an estimated noise signal by subtracting the first signal from the first error signal;

a second control effect estimation filter configured to convert the control signal into a second signal in accordance with a processed secondary path characteristic, the processed secondary path characteristic being obtained by shortening a delay included in the estimated secondary path characteristic by a time, the time corresponding to a period of the target sound multiplied by a constant; and an updating unit configured to update the control characteristic so that a second error signal which is a sum of the estimated noise signal and the second signal is minimized, wherein letting T be the period, a be the delay, and m be the constant, the constant is a positive integer satisfying $T \times m \leq a$.

2. The apparatus according to claim 1, wherein the constant is a maximum integer satisfying $T \times m \leq a$.

3. The apparatus according to claim 1, wherein the reference signal generator comprises a reference microphone which converts the target sound into the reference signal.

4. The apparatus according to claim 1, wherein the reference signal generator comprises the estimated noise signal generator, and the reference signal is the estimated noise signal.

5. The apparatus according to claim 1, further comprising:

a period calculation unit configured to calculate the period based on the reference signal; and a determination unit configured to determine the processed secondary path characteristic based on the calculated period.

6. An active noise-reduction apparatus for reducing a target sound, the apparatus comprising:

an error microphone which converts a sound including the target sound into an error signal;

a reference signal generator configured to generate a reference signal;

a control filter configured to convert, in accordance with a control characteristic, the reference signal into a control signal used to cancel the target sound;

a control loudspeaker which emits a control sound based on the control signal;

a control effect estimation filter configured to convert the control signal into a first signal in accordance with an estimated secondary path characteristic, the estimated secondary path characteristic generated based on a result of identifying a secondary path characteristic from the control loudspeaker to the error microphone in advance;

a secondary path filter configured to convert the reference signal into a first auxiliary signal in accordance with the estimated secondary path characteristic;

a virtual control effect estimation filter configured to convert the first auxiliary signal into a second signal in accordance with the control characteristic; and an updating unit configured to update the control characteristic so that an evaluation function based on the error signal and a second auxiliary signal is minimized, the second auxiliary signal being a difference between the second signal and the first signal.

7. The apparatus according to claim 6, wherein the reference signal generator comprises a reference microphone which converts the target sound into the reference signal.

8. The apparatus according to claim 6, wherein the reference signal generator generates the reference signal by subtracting the first signal from the error signal.

9. An active noise-reduction method for reducing a target sound having periodicity, the method comprising:

providing an error microphone which converts a sound including the target sound into a first error signal;

generating a reference signal;

converting, in accordance with a control characteristic, the reference signal into a control signal used to cancel the target sound;

providing a control loudspeaker which emits a control sound based on the control signal;

converting the control signal into a first signal in accordance with an estimated secondary path characteristic, the estimated secondary path characteristic being generated based on a result of identifying a secondary path characteristic from the control loudspeaker to the error microphone in advance;

generating an estimated noise signal by subtracting the first signal from the first error signal;

converting the control signal into a second signal in accordance with a processed secondary path characteristic, the processed secondary path characteristic being obtained by shortening a delay included in the estimated secondary path characteristic by a time, the time corresponding to a period of the target sound multiplied by a constant; and updating the control characteristic so that a second error signal which is a sum of the estimated noise signal and the second signal is minimized, wherein letting T be the period, a be the delay, and m be the constant, the constant is a positive integer satisfying $T \times m \leq a$.

10. The method according to claim 9, wherein the constant is a maximum integer satisfying $T \times m \leq a$.

11. The method according to claim 9, wherein the generating the reference signal comprises providing a reference microphone which converts the target sound into the reference signal.

12. The method according to claim 9, wherein the reference signal is the estimated noise signal.

13. The method according to claim 9, further comprising:

calculating the period based on the reference signal; and determining the processed secondary path characteristic based on the calculated period.

14. An active noise-reduction method for reducing a target sound, the method comprising:

providing an error microphone which converts a sound including the target sound into an error signal;

generating a reference signal;

converting, in accordance with a control characteristic, the reference signal into a control signal used to cancel the target sound;

providing a control loudspeaker which emits a control sound based on the control signal;

converting the control signal into a first signal in accordance with an estimated secondary path characteristic, the estimated secondary path characteristic generated based on a result of identifying a secondary path characteristic from the control loudspeaker to the error microphone in advance;

converting the reference signal into a first auxiliary signal in accordance with the estimated secondary path characteristic;

converting the first auxiliary signal into a second signal in accordance with the control characteristic; and updating the control characteristic so that an evaluation function based on the error signal and a second auxiliary signal is minimized, the second auxiliary signal being a difference between the second signal and the first signal.

15. The method according to claim 14, wherein the generating the reference signal comprises providing a reference microphone which converts the target sound into the reference signal.

16. The method according to claim 14, wherein the generating the reference signal comprises generating the reference signal by subtracting the first signal from the error signal.

* * * * *